US011466960B2

(12) United States Patent
Noskowicz

(10) Patent No.: US 11,466,960 B2
(45) Date of Patent: Oct. 11, 2022

(54) INTENSITY ADAPTING OPTICAL AIMING RETICLE

(71) Applicant: Christopher Noskowicz, San Clemente, CA (US)

(72) Inventor: Christopher Noskowicz, San Clemente, CA (US)

( * ) Notice: Subject to any disclaimer, the term of this patent is extended or adjusted under 35 U.S.C. 154(b) by 1148 days.

(21) Appl. No.: 16/014,626

(22) Filed: Jun. 21, 2018

(65) Prior Publication Data

US 2018/0372448 A1 Dec. 27, 2018

Related U.S. Application Data

(60) Provisional application No. 62/523,016, filed on Jun. 21, 2017.

(51) Int. Cl.

| | |
|---|---|
| ***F41G 1/34*** | (2006.01) |
| ***F41G 1/38*** | (2006.01) |
| ***F41G 1/30*** | (2006.01) |
| ***F41G 1/14*** | (2006.01) |

(52) U.S. Cl.

CPC ..... *F41G 1/345* (2013.01); *F41G 1/14* (2013.01); *F41G 1/30* (2013.01); *F41G 1/38* (2013.01)

(58) Field of Classification Search

CPC ... F41G 11/00; F41G 1/01; F41G 1/14; F41G 1/30; F41G 1/38; F41G 1/32; F41G 1/34; F41G 1/345; G02B 27/32; G02B 27/36; G02B 27/34

See application file for complete search history.

(56) References Cited

U.S. PATENT DOCUMENTS

| | | | | |
|---|---|---|---|---|
| 2,441,823 | A * | 5/1948 | Kurlander | H01K 9/00 313/111 |
| 3,552,819 | A * | 1/1971 | Mandler | G02B 27/34 359/365 |
| 3,833,799 | A * | 9/1974 | Audet | F41G 1/345 42/132 |
| 3,880,529 | A * | 4/1975 | Althause | G02B 27/34 356/251 |
| 4,764,011 | A * | 8/1988 | Goldstein | F41G 1/30 356/251 |
| 4,832,451 | A * | 5/1989 | Trescott | G02B 27/30 244/3.16 |
| 5,653,034 | A | 8/1997 | Bindon | |
| 6,807,742 | B2 * | 10/2004 | Schick | F41G 1/30 33/297 |
| 8,713,845 | B1 * | 5/2014 | Stenton | F41G 1/345 42/123 |
| 10,088,275 | B1 * | 10/2018 | Warren | F41G 1/345 |
| 2004/0047586 | A1 * | 3/2004 | Schick | F41G 1/34 385/147 |
| 2008/0186571 | A1 * | 8/2008 | Wagner | G02B 17/045 359/428 |

(Continued)

*Primary Examiner* — Benjamin P Lee

(74) *Attorney, Agent, or Firm* — Gurr Brande & Spendlove, PLLC.; Robert Dan Spendlove

(57) ABSTRACT

An intensity adapting optical aiming system that automatically adjusts the intensity of the reticle to adapt to the light condition of the external light. The aiming system may be mounted to a weapon and the external light may be a weapon mounted light. The aiming system may include an illuminateable reticle and a light connector for transmitting light from the external light to the reticle.

20 Claims, 17 Drawing Sheets

(56) References Cited

U.S. PATENT DOCUMENTS

| | | | | |
|---|---|---|---|---|
| 2009/0100735 | A1* | 4/2009 | Schick | F41G 1/345 42/123 |
| 2009/0193705 | A1* | 8/2009 | LoRocco | F41G 1/30 42/123 |
| 2010/0083554 | A1 | 4/2010 | Elpedes et al. | |
| 2012/0000979 | A1* | 1/2012 | Horvath | F41G 1/38 235/407 |
| 2012/0013258 | A1* | 1/2012 | Browe | F41G 1/345 315/158 |
| 2018/0224242 | A1* | 8/2018 | Bellah | F41G 1/345 |

* cited by examiner

300

400

INTENSITY ADAPTING OPTICAL AIMING RETICLE

FIELD OF INVENTION

The invention is related generally to an aiming sight reticle that is illuminated. More particularly, embodiments of the invention relate to an illuminated sight reticle for a firearm.

BACKGROUND

Optical aiming devices may be employed in to aid in aiming devices that require accurate direction or sighting, including for example, firearms, other projectile weapons, spotting scopes, and the like. Examples of such aiming devices known in the art may employ a sight to assist in the aiming of the device. Known sights may include lenses, reticles or both. A reticle may generally consist of indicia imposed on the user's field of view that assist with aiming and may include cross hairs, dots and the like.

The reticle, and the sight-assisting portion of the reticle in particular, may be illuminated in various colors. The reticle may be self-illuminated or ambient light powered. In known embodiments of such self-illuminated optics, the reticle becomes difficult if not impossible to see when an auxiliary light source, such as a weapon light (flashlight), is turned on, illuminating the target. This makes the sight useless because the aiming point of the reticle disappears as it is washed out by the activated light source. The light source may be held in the off position until needed and activated at the instant when needed, often for the element of surprise. The aiming point of the reticle is, therefore, instantly needed as the light turns on the target is visible and action by use of the sight is needed almost immediately. However, just at the time the sight is needed, known lighted reticles are unusable as described above.

Known aiming devices provide no solution for this problem. Existing reticles may employ a battery powered optic reticle that illuminates the indicia of the reticle. However, with such devices, the brightness remains constant or is manually adjustable and cannot adapt to the fast changing light conditions caused by activating other light sources including for example a weapon mounted light. Other reticles that use ambient light to illuminate the reticle do not compensate for the brightness of the light on the target and aiming point invisible.

Accordingly, there is a long felt need for an improved apparatus for light adjusting aiming aid.

BRIEF DESCRIPTION OF THE DRAWINGS

The figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1A:
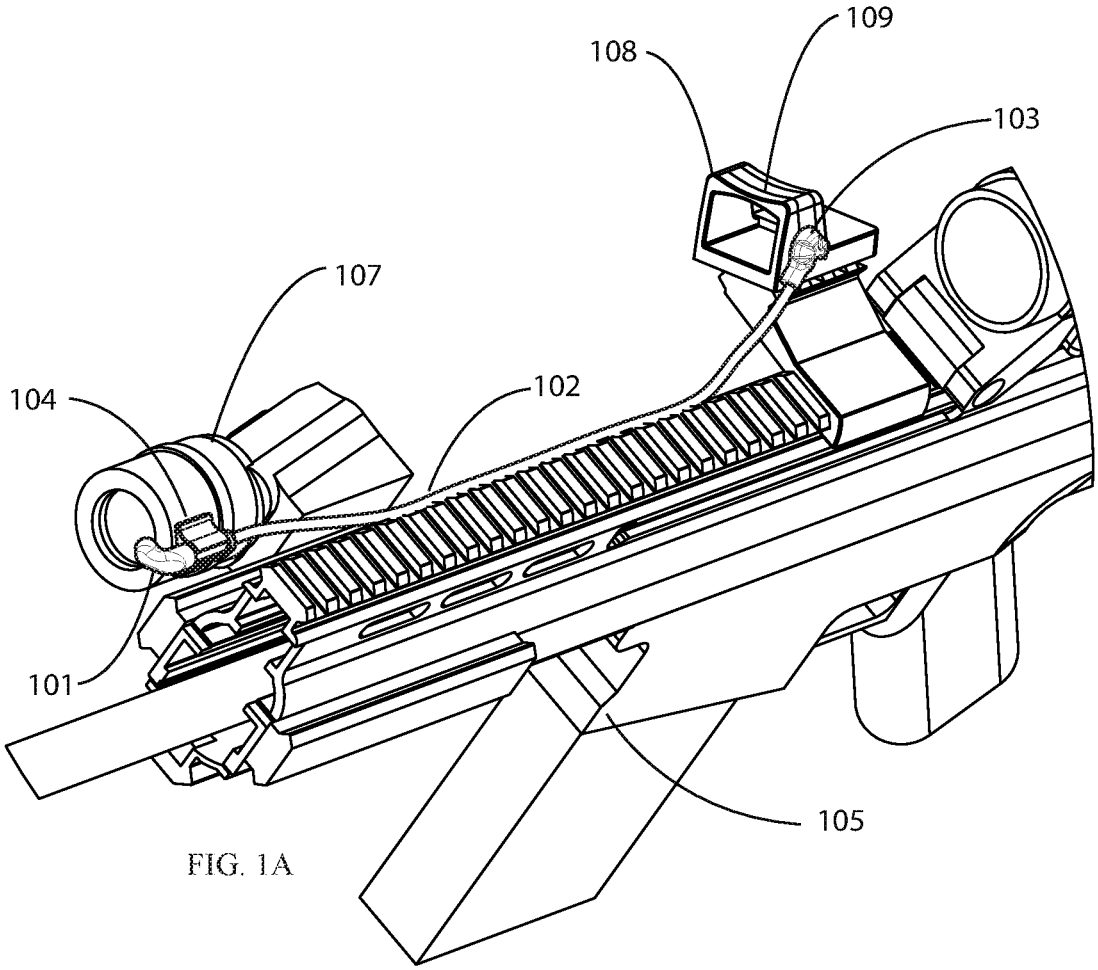
FIG. 1A illustrates an embodiment of an intensity adapting apparatus for an optical aiming device.

Skilled artisans will appreciate that elements in the figures are illustrated for simplicity and clarity and have not necessarily been drawn to scale. For example, the dimensions of some of the elements in the figures may be exaggerated relative to other elements to help improve understanding of embodiments of the present invention.

DETAILED DESCRIPTION OF THE DRAWINGS

While the present invention is achievable by various forms of embodiment, there is shown in the drawings and described hereinafter several examples of embodiments with the understanding that the present disclosure is to be considered an exemplification of the invention and is not intended to limit the invention to the specific embodiments contained herein as will become more fully apparent from the discussion below. It is further understood that the intensity adapting optical aiming reticle apparatus of the present invention may be used more generally in any application where it is desirable to provide aim assistance in rapidly changing lighting conditions and the like.

Before describing in detail exemplary embodiments that are in accordance with the present invention, it should be observed that the embodiments reside primarily in combinations of apparatus components related to illuminated reticles. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

The instant disclosure is provided to further explain in an enabling fashion the best modes of making and using various embodiments in accordance with the present invention. The disclosure is further offered to enhance an understanding and appreciation for the invention principles and advantages thereof, rather than to limit in any manner the invention.

It is further understood that the use of relational terms, if any, such as first and second, top and bottom, and the like are used solely to distinguish one from another entity or action without necessarily requiring or implying any actual such relationship or order between such entities or actions.

An optical aiming device, often comprising a reticle, may be used for aiming assistance, by use of an aiming point whether for binoculars, spotting scopes, microscopes, weaponry, range finders and the like. The optical aiming device may be a reticle or other aiming point that is illuminateable. The reticle, or at least portions or markings of the reticle are illuminated so that the reticle markings, i.e. the aiming point or points, lines, tick marks, cross hairs, aiming pattern and the like are visible. The illumination intensity of the reticle markings may be adjusted so that the brightness of the reticle markings does not over power the intended target in the viewing sight of the aiming device. Typically in low or even no-light conditions the reticle markings are set to a level that makes them visible to a user but not over powering and therefore making the intended target difficult to see or at least distracting. For example, U.S. Patent Application Publication No. 2010/0083554A1, which is incorporated herein by reference, teaches an optical sight. The optical sight may include an optical element and a reticle displayed on the optical element. In addition, U.S. Pat. Nos. 5,653,034 and 6,807,742 teach a "Reflex sighting device for day and night sighting" and a "Reflex sight with multiple power sources for reticle," respectively. Both of these patents are also incorporated herein by reference.

Figure 1B:
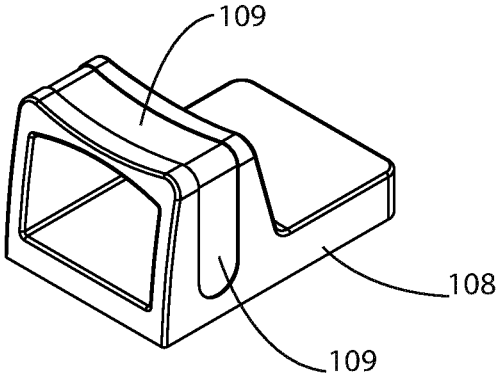
FIG. 1B shows a perspective view of a reticle in accordance with the embodiment of FIG. 1A
Figure 1C:
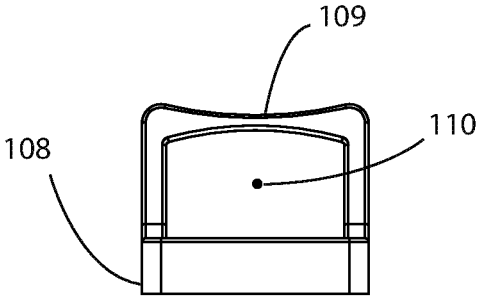
FIG. 1C shows a forward facing view of the reticle of FIG. 1B.
Figure 2A:
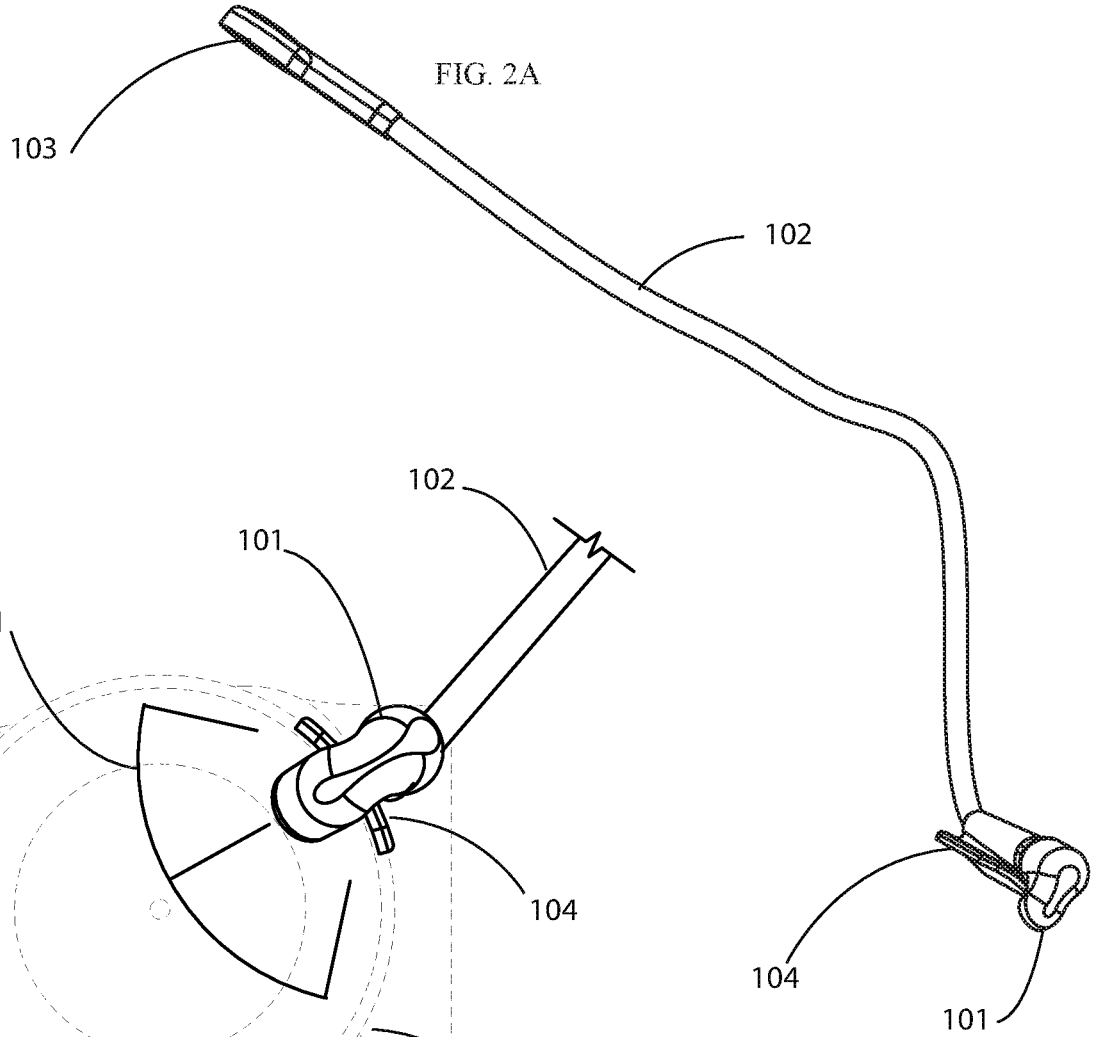
FIG. 2A illustrates an embodiment of an intensity adapting apparatus for an optical aiming device.
Figure 2B:
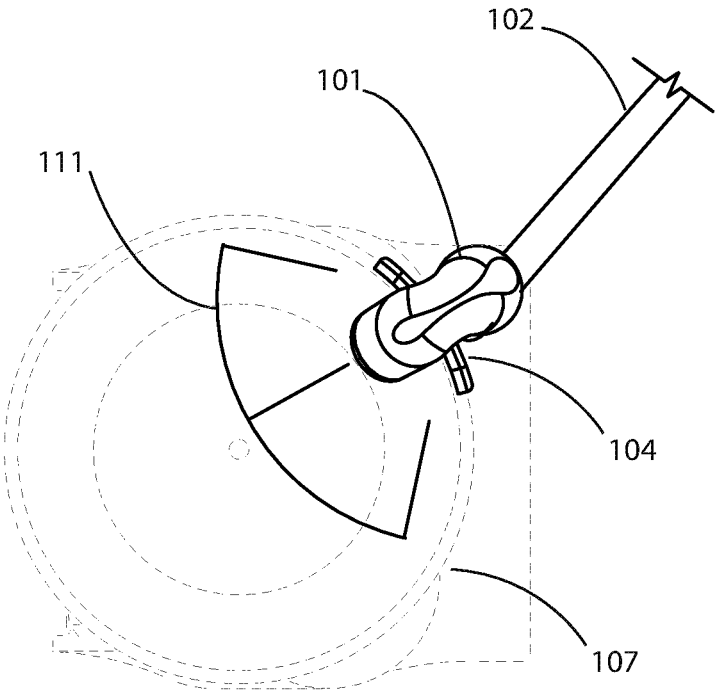
FIG. 2B shows an end view of the input end of the intensity adapting apparatus in accordance with the embodiment of FIG. 2A in conjunction with a light source.
Figure 2C:
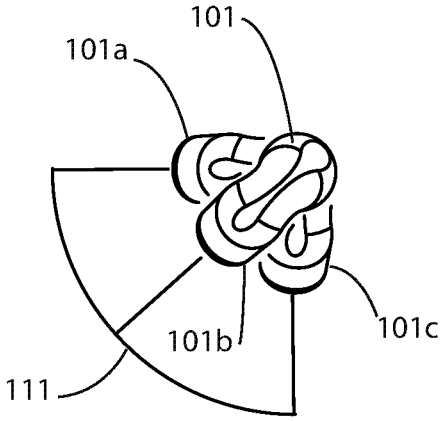
FIG. 2C shows an end view of the input end of the intensity adapting apparatus in accordance with the embodiment of FIG. 2A.
Figure 3:
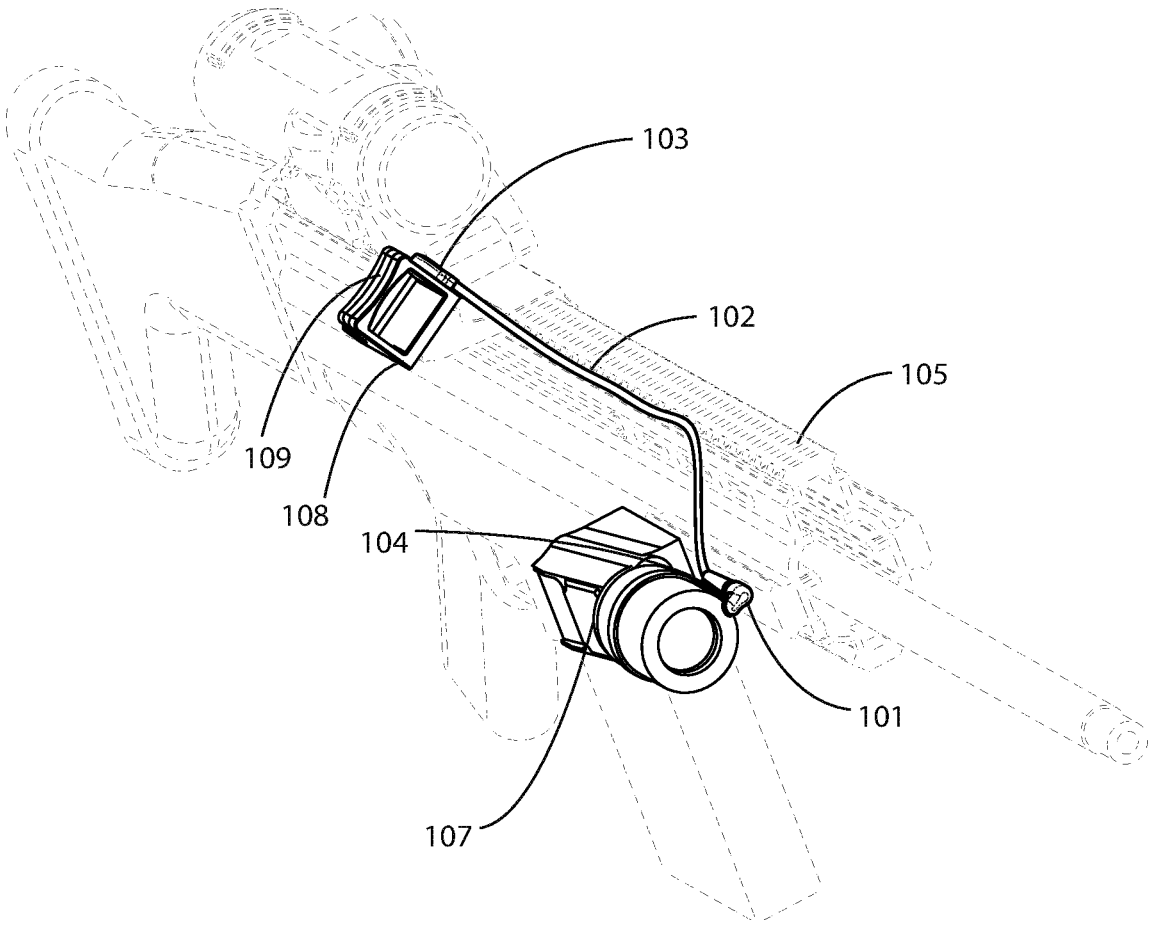
FIG. 3 illustrates a further embodiment of an intensity adapting apparatus for an optical aiming device.

FIGS. 1-3 illustrate an embodiment of an intensity adapting apparatus for an optical aiming device. The apparatus may comprise an optical aiming device 108 mounted to a weapon 105. A light source 107 is also mounted to, or part of, the weapon 105 in this embodiment. A light connector 102 transmits light from the light source 107 to the optical aiming device 108. The optical aiming device 108 may have a reticle 110 see FIG. 1B-1C, and a reticle ambient light collector 109. In this embodiment the reticle ambient light collector 109 may be on one or more sides of the optical aiming device 108. The light connector 102 may have a light input end 101 and a light output end 103. The light input end 101 of the light connector 102 is positioned to receive light from the light source 107. In this embodiment, the light input end 101 of the light connector 102 is held in place with light input mount 104. The mount 104 in this embodiment is mounted to the light source 107.

As illustrated in FIGS. 2A, 2B and 2C, light input 101 may be mounted such that the input is positioned in the beam of the light source 107 (shown here in dashed lines). The light input 101 is held in place with mount 104. The light input mount 104 positions the light input end 101 such that light emitted from the light source 107 is received by the light input end 101 and then transmitted through the light connector 102. Said another way, the light input end 101 is in the direct path, or nearly the direct path of the light from the light source 107. As shown in FIGS. 2B-C, the input may be placed in the path the light source across an area 111 extending in an arc across a portion of the beam of the light source. As specifically illustrated in FIG. 2C, the input may be placed at various angles 101*a-c* with respect to the light source. Such a configuration allows the intensity of the reticle to be adjusted by positioning the input in the desired location relative to the light source. The clocked position 101*a-c* of the light collector 101 determines how much light the input captures from the flashlight. Embodiments shown in FIGS. 1A-C illustrate the mount 104 attached directly to the light source (flashlight). Alternatively, the mount may be attached to other components of the system, such as directly to the weapon 105 or to other components.

When the light source 107 is activated, light emitted by the source is received by the light input end 101, transmitted by the light connector 102 to the light output end 103, and transmitted into the optical aiming device 108 through the reticle ambient light collector 109. The light is channeled through the light connector 102 from the light source 107 to the aiming device 108. This channeled light is received in the aiming device 108 and directed to the reticle 110, which causes the brightness of the reticle 110, to increase. The light from the light source 107 directly illuminates the reticle 110. The brightness or the illumination by the light source is directly proportional to the brightness of the light source 107. Therefore, when the light source 107 is activated, the brightness level of the reticle 110 increases.

The reticle 110 may already be illuminated through its own illumination source or by ambient light, and when the light source 107 is activated, the brightness of the reticle 110 increases. This allows the reticle 110 to brighten sufficiently to remain visible to the user, and not be washed out due to the higher intensity of light produced by the light source 107.

For example, when using the reticle, e.g. aiming point, cross hairs etc., in very low light, in a first light state, the brightness of the reticle 110 is initially low, matching the current lighting conditions; this state is prior to the light source 107 being illuminated. In this first light state, the low level of illumination of the reticle does not interfere with the viewing of the object being targeted or aimed at while viewing the object through the reticle. Once the light source 107 is turned on, the brightness of the reticle increases so that it remains visible and not washed out by the rapid increase in light due to the activation of the light source 107. The brightness or intensity of the reticle 110 adapts automatically, as it has a fast response time, as the light from the light source 107 is used to simultaneously illuminate the intended target as well as the aiming point of the reticle 110.

As shown in FIG. 1A and FIG. 3, the light connector 102, which comprises a fiber optic cable in this embodiment, runs from the light source 107, along the weapon 105 and may be mounted to the weapon 105 at one or more points along the weapon 105, and to the optical aiming device 108. The light connector 102 may be made long enough to be adapted to weapons of various length, different mounting positions of both the light source or the optical aiming device 108. In this embodiment, the light connector 102 is shown in a linear fashion however, it is to be understood that there may be loops in the cable or it may wind in various fashions around the weapon as it is strung from the light source 107 to the optical aiming device 108.

In embodiment of the apparatus, the light connector 102 uses a fiber optic cable, which may be a Plastic Optic Fiber (POF) to transmit light directly from a flashlight (i.e. the light source 107) to the reticle. The light input end 101 in one embodiment may be the end of the fiber optic cable. In one embodiment the end of the fiber optic cable may be pointed directly at the light source 107. In other embodiments the light input end 101 may be generally in the light source path but not directly pointed at the light source 107. The fiber optic cable may be jacketed fiber cable of commercial grade and preferably between 1 and 5 mm in diameter or more preferably around 3 mm in diameter. It is to be understood that any fiber optic cable that carries or transmits light from one end to the other may be employed.

Figure 4:
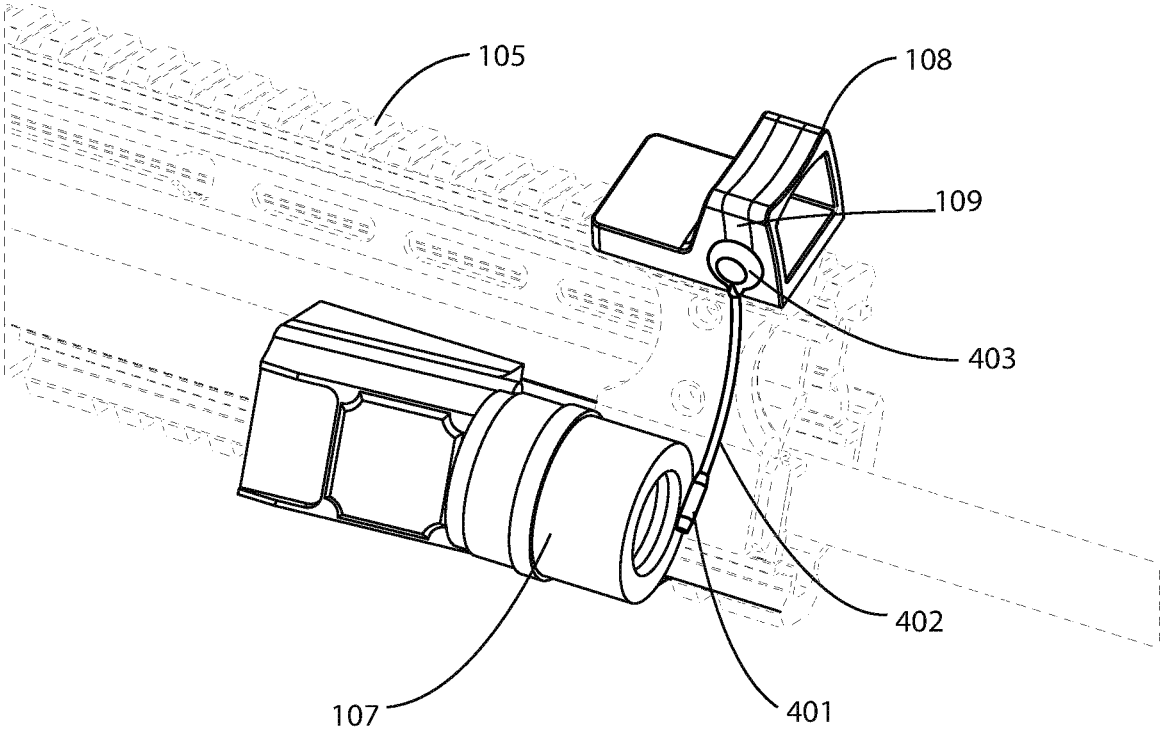
FIG. 4 illustrates a further embodiment of an intensity adapting apparatus for an optical aiming device.

FIG. 4 illustrates an embodiment of an intensity adapting apparatus comprising an optical aiming device 108 mounted to a weapon 105. A light source 107 is also mounted to, or part of, the weapon 105. A light connector 402 is mounted to the reticle 110. The light connector 402 may have a light input end 401 and a light output end 403. The light connector 402 may be a fiber optic cable that is carried by or mounted to a formable material such as a wire or other formable material. The light connector may be made out of formable material without the use of addition formable carriers or wires. The formable material allows the light connector 402 to be bent and formed such that the light input end 401 can be positioned in the path of the light emitted from the light source 107, while the light input end is mounted to the reticle 110. As with the previous embodiments, the light from the light source 107 is transmitted through the light connector 402 to the reticle, when the light source is activated.

Figure 5:
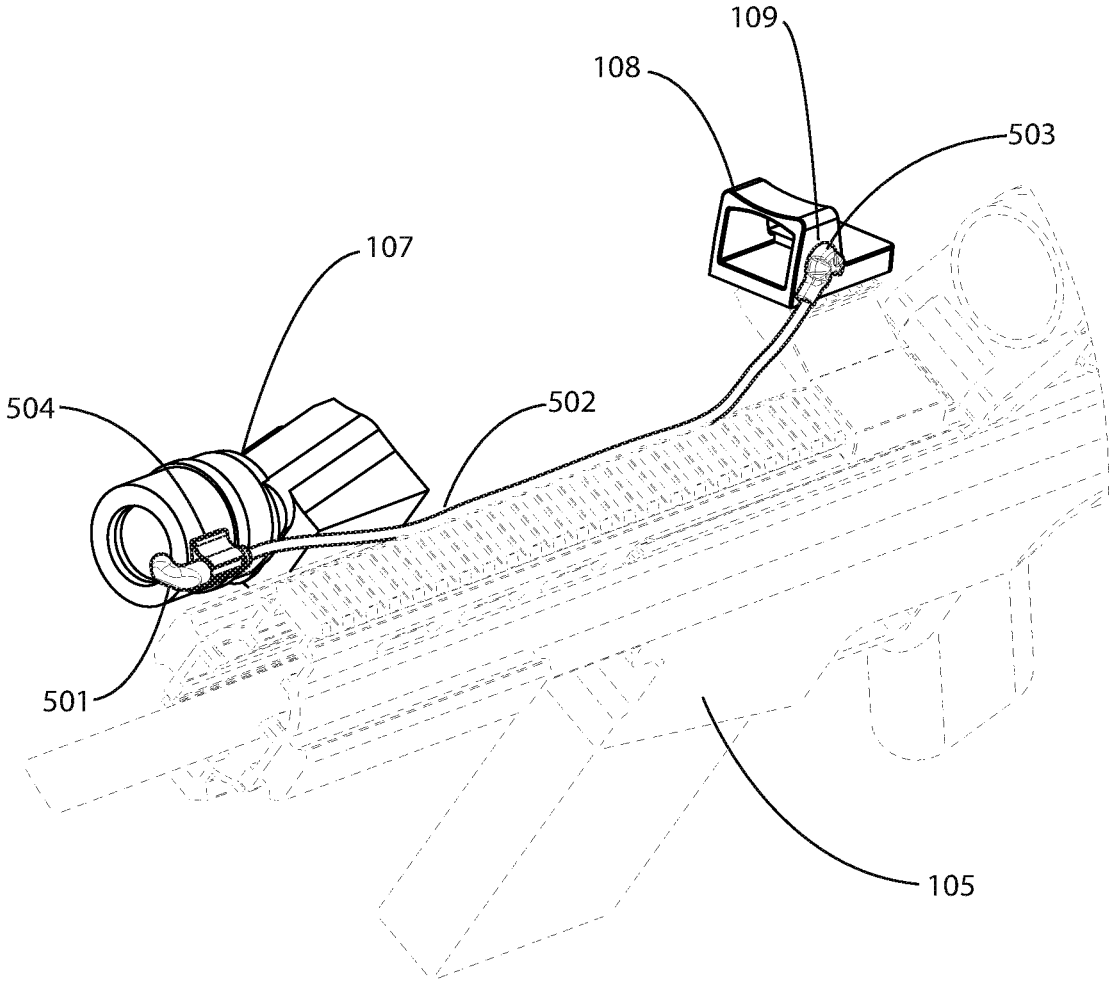
FIG. 5 illustrates a further embodiment of an intensity adapting apparatus for an optical aiming device.

FIG. 5 illustrates an embodiment of an intensity adapting apparatus comprising an optical aiming device 108 mounted to a weapon 105. A light source 107 is also mounted to, or part of, the weapon 105. The light connector 502 may include a light sensor 501 coupled by at least one wire to a second light source 503. When light 107 is activated the light sensor 501 detects the light. An electrical conductor 502 transmits signal from the light sensor 501 to the second light source, which may be an LED 503, through a control circuit not shown. The LED 503 emits light into optic reticle 108 ambient light collector 109. The optical aiming device 108 may have a reticle 110 see FIG. 1B-1C, and a reticle ambient light collector 109.

In this exemplary embodiment, the reticle ambient light collector 109 may be on one or more sides of the optical aiming device 108. The light connector 502 may have a light sensor end 501 and a light output end 503. The light sensor end 501 of is positioned to receive light from the light source 107. Light output end 503 has an LED with an independent power source, and is positioned to transmit light to the light collector (109) of optic (108).

When Flashlight 107 is activated, the sensor 201 transmits a signal to the light output 503. Light output 503 transmits light into the reticle ambient light collector 109. In this embodiment, the light sensor end 501 of the light connector 502 is held in place with light sensor mount 504. The mount 504 in this embodiment is mounted to the light source 107. As shown in FIG. 5, the light connector 502, which comprises an electrical conductor in this embodiment, runs from the light source 107, along the weapon 105 and may be mounted to the weapon 105 at one or more points along the weapon 105, to the optical aiming device 108. The light connector 502 may be made long enough to be adapted to weapons of various lengths, different mounting positions of both the light source or the optical aiming device 108. In this embodiment, the light connector 102 is shown in a linear fashion however, it is to be understood that there may be loops in the cable or it may wind in various fashions around the weapon as it is strung from the light source 107 to the optical aiming device 108.

In embodiments consistent with FIG. 5, the light connector 102 uses electrical conducting cable. In one embodiment the metal portions of the weapon may be used as one of the conductors and second wire runs between the light sensor 501 and the second light source 503. Additionally the control circuit controls when the second light source 503 turns on. A power source such as a battery powers the control circuitry, the sensor and the second light source 503.

Figure 6A:
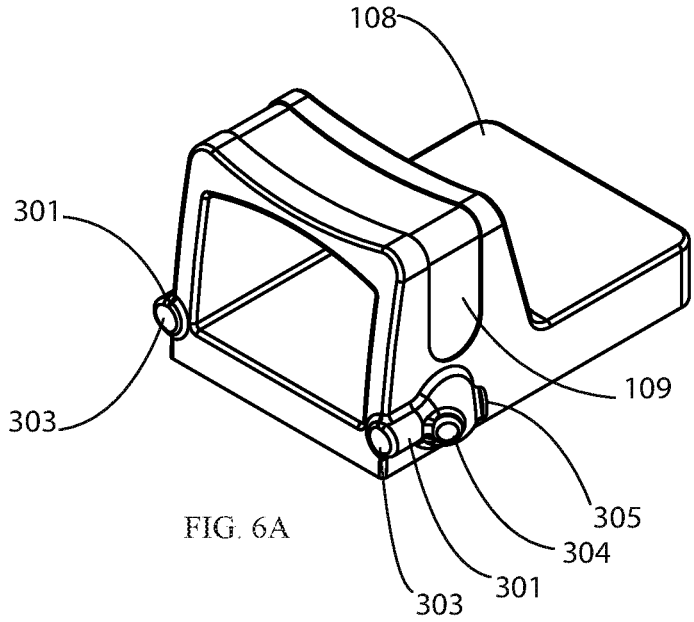
FIG. 6A illustrates an embodiment of a reticle for use with an intensity adapting apparatus.
Figure 6B:
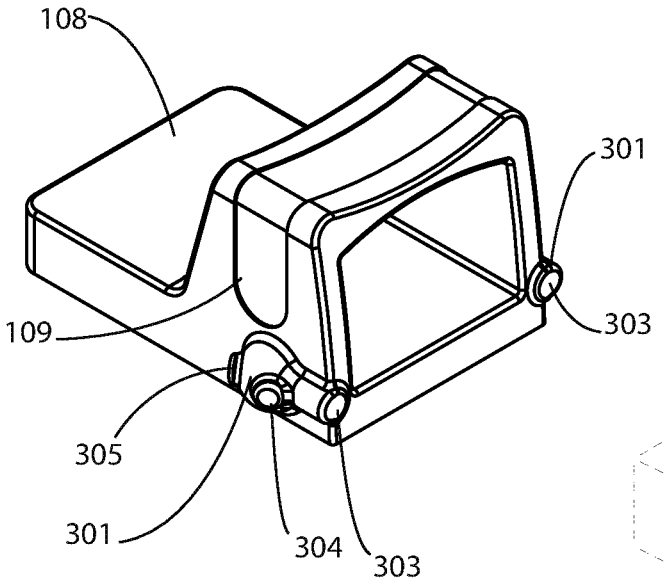
FIG. 6B illustrates a further embodiment of a reticle for use with an intensity adapting apparatus.
Figure 6C:
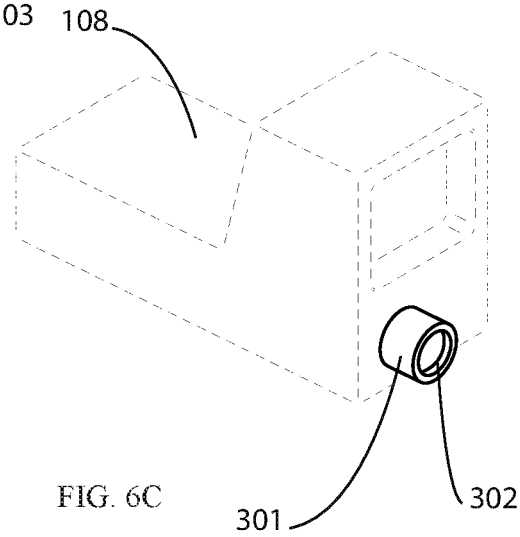
FIG. 6C illustrates a further embodiment of a reticle for use with an intensity adapting apparatus.

FIGS. 6A, 6B and 6C illustrate embodiments of a reticle for use with an intensity adapting apparatus. Configuration 300 shows a stand-alone optic 108 with sensor array 301. Sensor array 301 may include one forward-looking sensor 302 and one or more light sensors 302, 303 and 304. It is understood the number of sensors and specific placement may vary and are show here for reference. Sensor array 301 detects ambient light conditions and light from light 107 that has reflected off of the target. An internal circuit commands the intensity of the reticle 110 FIG. 1C.

Figure 7:
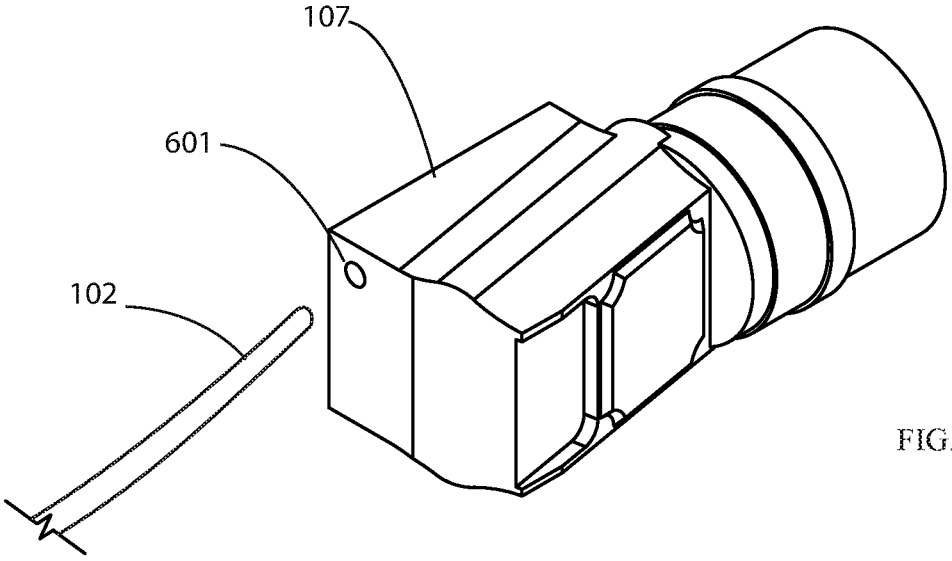
FIG. 7 illustrates an embodiment of a light source for use with an intensity adapting apparatus.

FIG. 7 configuration 400 shows a light source 107, shown as a flashlight, light connector 102 and a receptacle 601. The light connector 102 mechanically connects to the receptacle 601. Light source 107 transmits light from the receptacle 601 to light connector 102.

Figure 8:
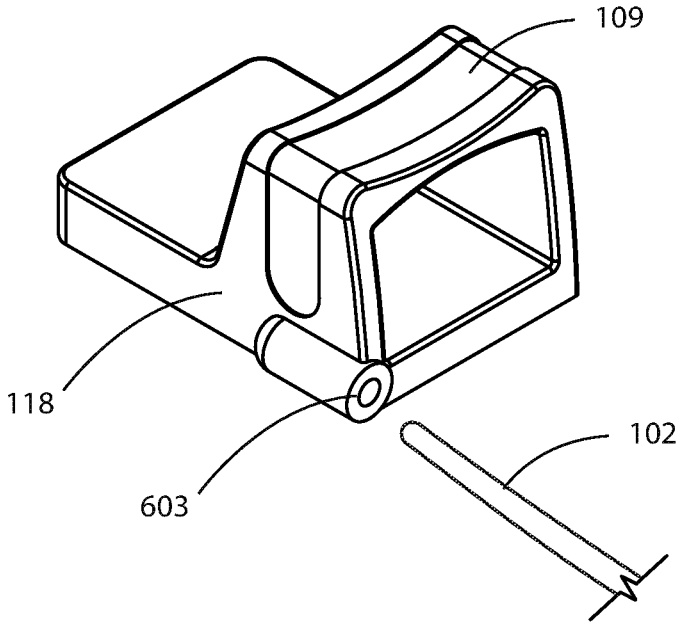
FIG. 8 illustrates an embodiment of a reticle for use with an intensity adapting apparatus.

FIG. 8 shows the light connector 102 connecting directly to the optic 107 through a dedicated receptacle 603. The light connector 102 transmits light to optic 118 through receptacle 603 that transmits light to the reticle 110.

Figure 9:
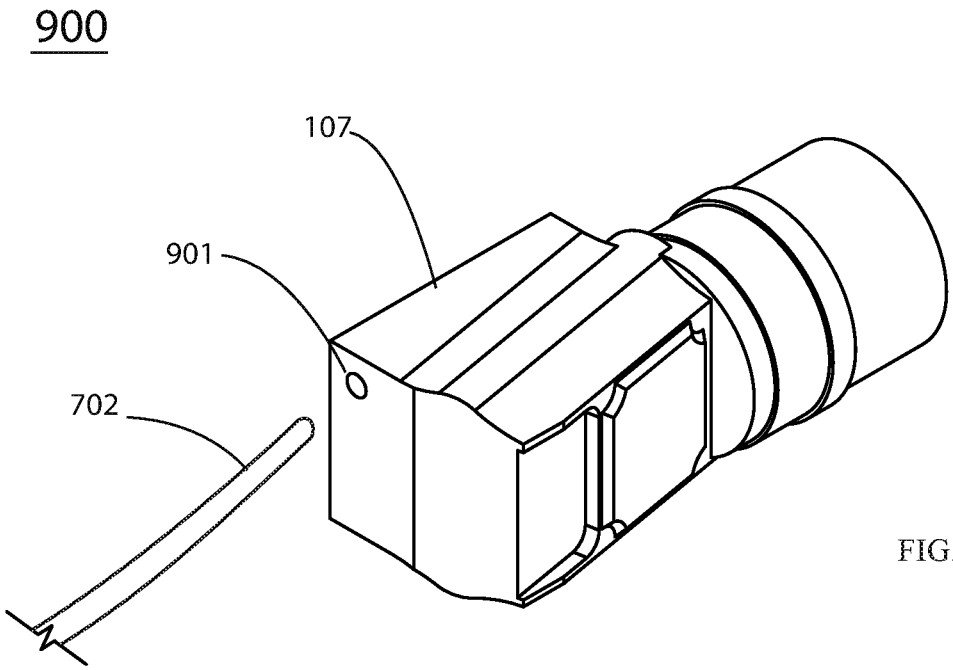
FIG. 9 shows a further embodiment of a light source for use with an intensity adapting apparatus.

FIG. 9 illustrates an embodiment of an intensity adapting apparatus that shows light source 107, a light connector 702 and a receptacle 901. Light connector 702 mechanically connects to receptacle 901. Flashlight 107 transmits electrical signal from the receptacle 901 to light connector 702.

Figure 10:
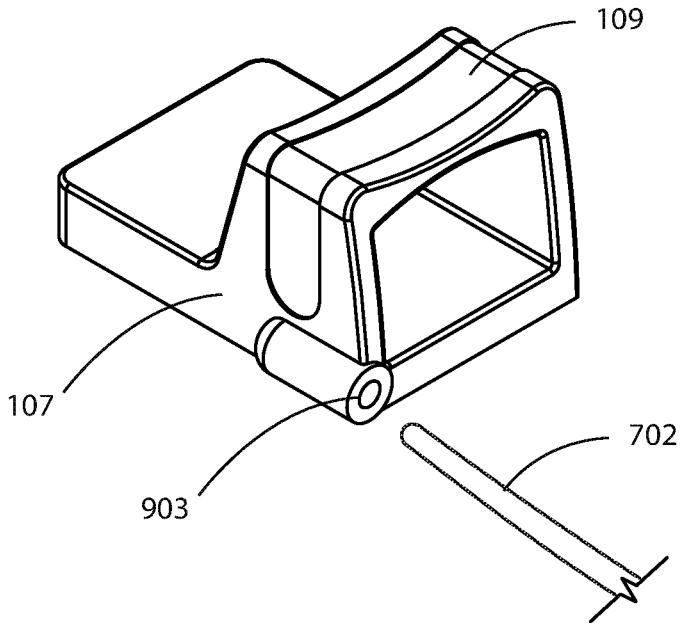
FIG. 10 shows a further embodiment of a reticle for use with an intensity adapting apparatus.

FIG. 10 shows light connector 702 connecting directly to optic 107 through dedicated receptacle 903. Light connector 702 transmits electrical signal to optic 107 through receptacle 903.

Figure 11:
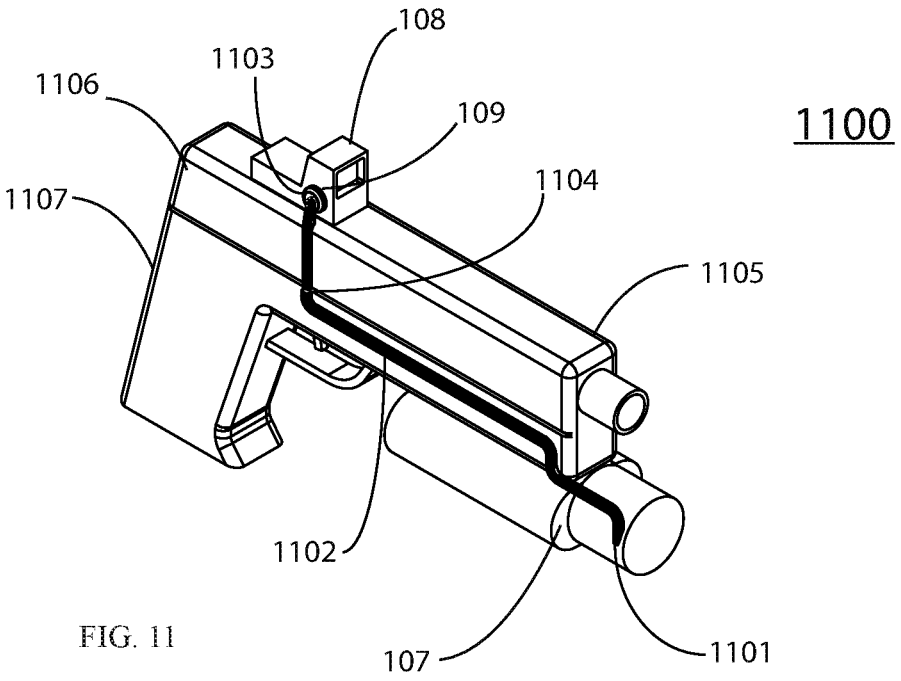
FIG. 11 shows a perspective view of an intensity adapting apparatus for an optical aiming device as used with a pistol
Figure 12:
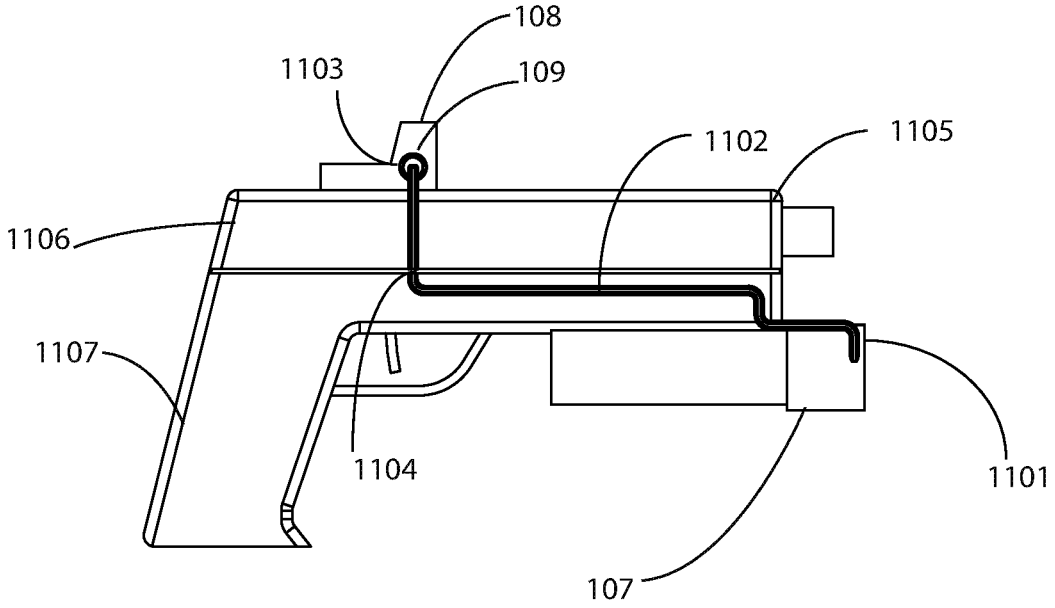
FIG. 12 shows a side view of the embodiment of FIG. 11.

FIG. 11 and FIG. 12 Illustrate a configuration 1100 for a typical pistol 1105 with a light source 107 mounted to frame 1107 and optic 108 mounted to slide 1106. Light connector 1102 has a break 1104 that allows mechanical movement between the slide 1106 and the frame 1107.

Figure 13:
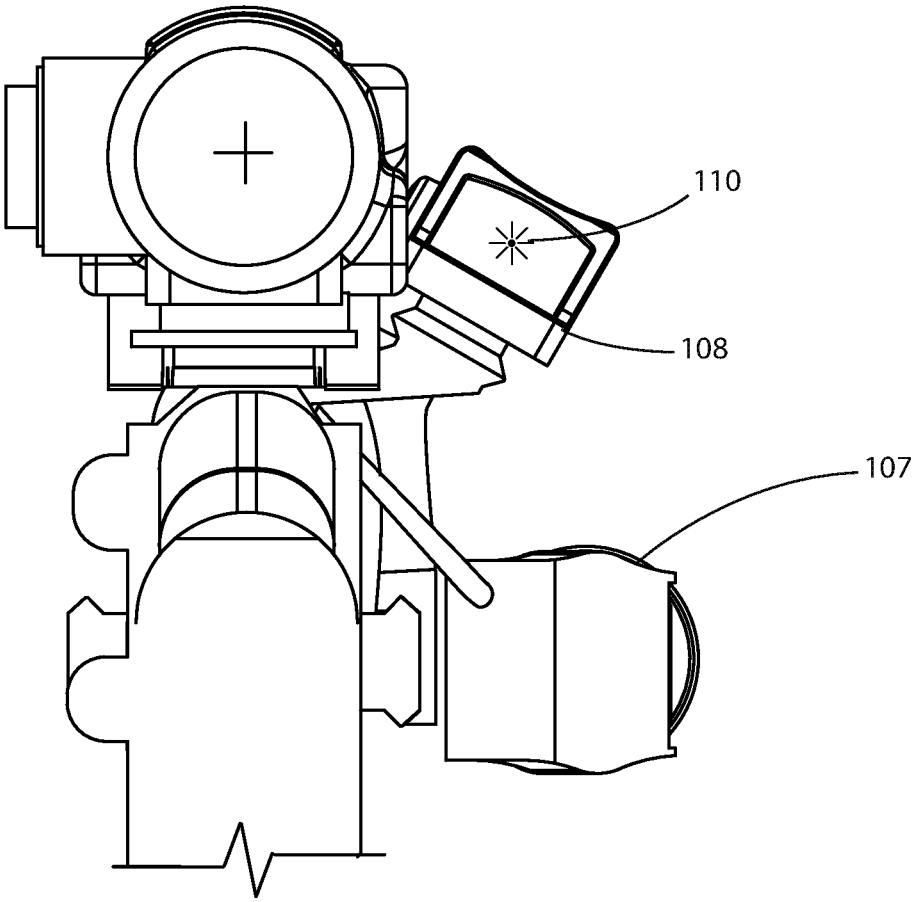
FIG. 13 shows a view of the weapon system in a first brightness state as viewed during typical operation in accordance with embodiments of the intensity adapting apparatus.
Figure 14:
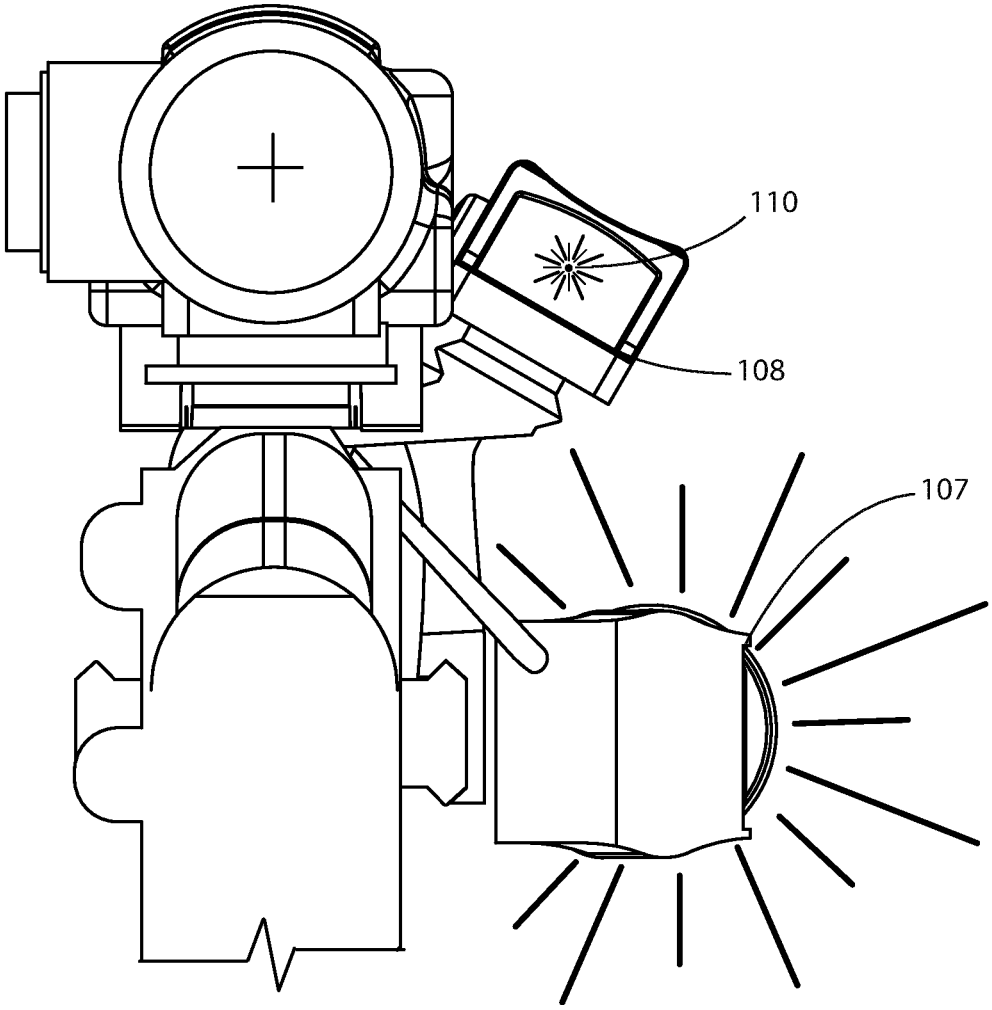
FIG. 14 shows the embodiment of FIG. 13 in a second brightness state.

FIG. 13 shows a view of the weapon system as viewed during typical operation. Optic 108 with reticle 110 is at a first brightness state. FIG. 14 depicts the flashlight 107 activated, thus increasing the intensity of reticle 110 to a second brightness state.

Figure 15A:
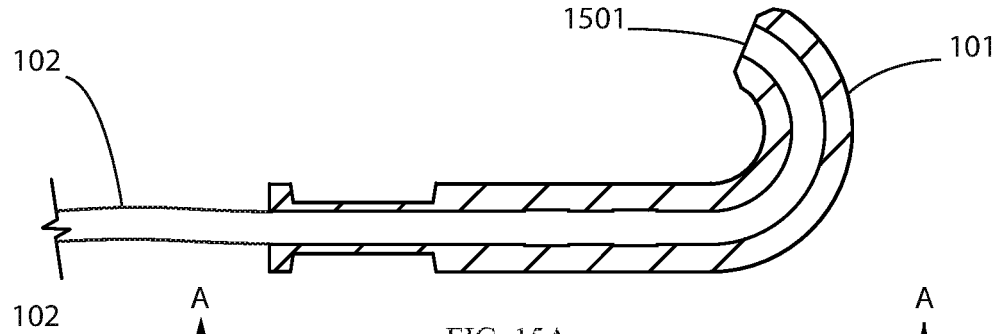
FIG. 15A is a cross-section view of the input end of FIG. 15B.
Figure 15B:
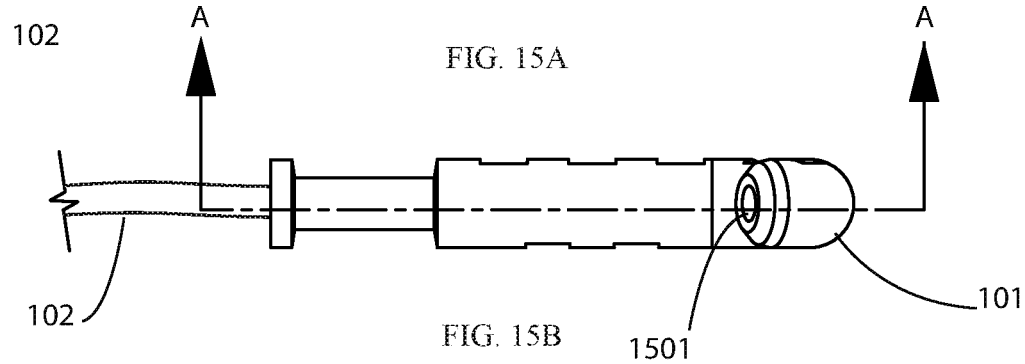
FIG. 15B shows a side view of an embodiment of an input end for use with an intensity adapting apparatus.

FIG. 15 shows cut away view of FIG. 15B. Light connector 102 is affixed to input 101 and terminated at light collector end 1501. Light from light source (107) enters the light collector at interface 1501 and is transmitted through the connector 102.

Figure 15C:
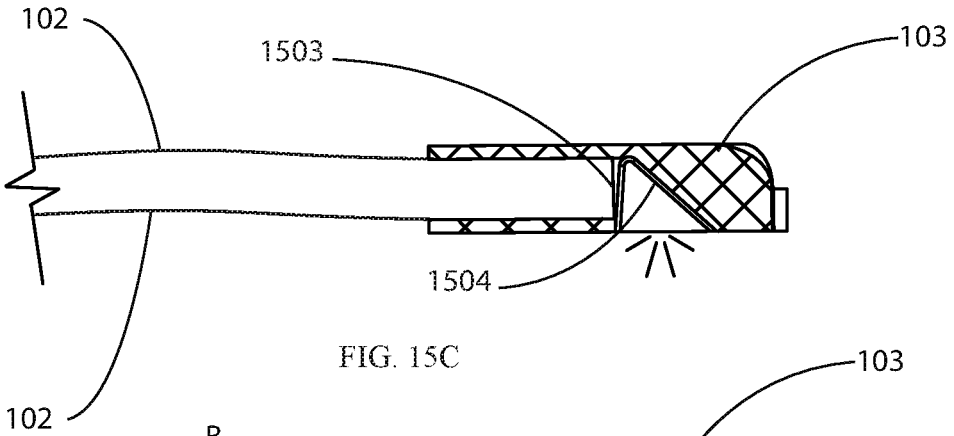
FIG. 15C is a cross-section view of the input end of FIG. 15D.
Figure 15D:
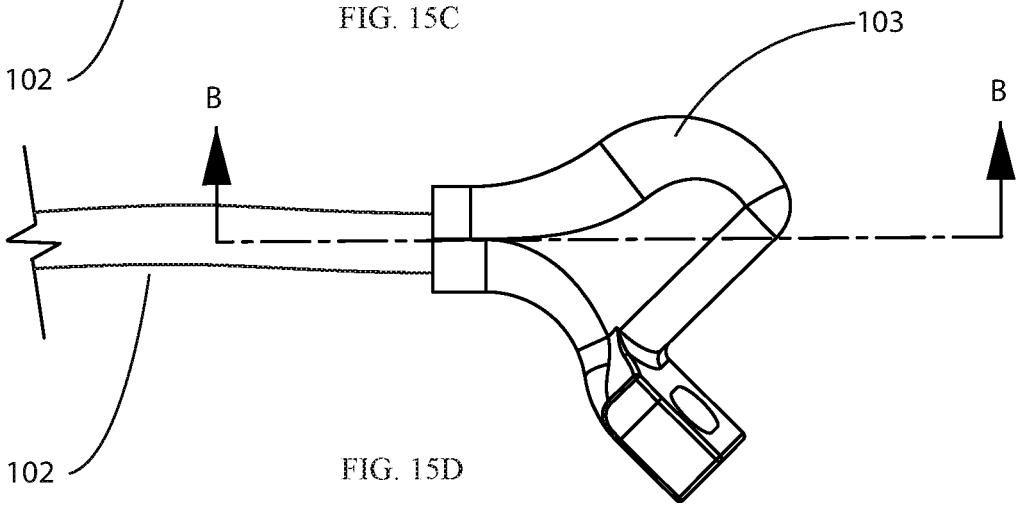
FIG. 15D shows a side view of an embodiment of an light output for use with an intensity adapting apparatus

FIG. 15C shows cut away view of FIG. 15D. Light connector 102 is affixed to output end 103 and terminated at light connector end 1503. Light travels through light connector 102 and radiates from light connector end 1503. The light reflects off of surface 1504 and into light collector (109) of the aiming device (108).

Figure 16:
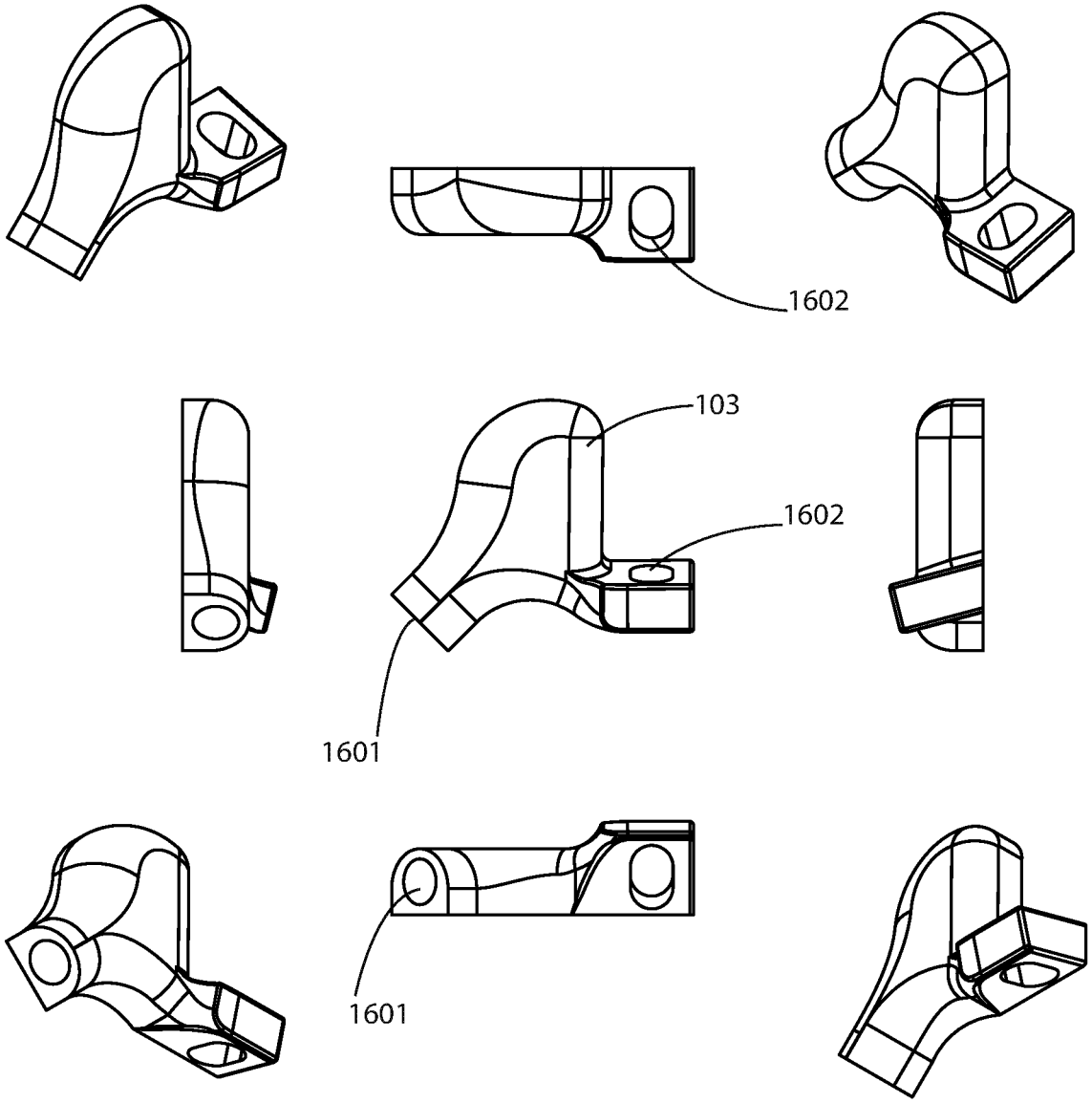
FIG. 16 shows various side and perspective views of an embodiment of a light output of the intensity adapting apparatus.

FIG. 16 shows a light output end 103 with a slot 1602 for mounting to the weapon system. Light connector (102) engages with and/or mounts to a recess 1601 formed in the light output 103.

Figure 17:
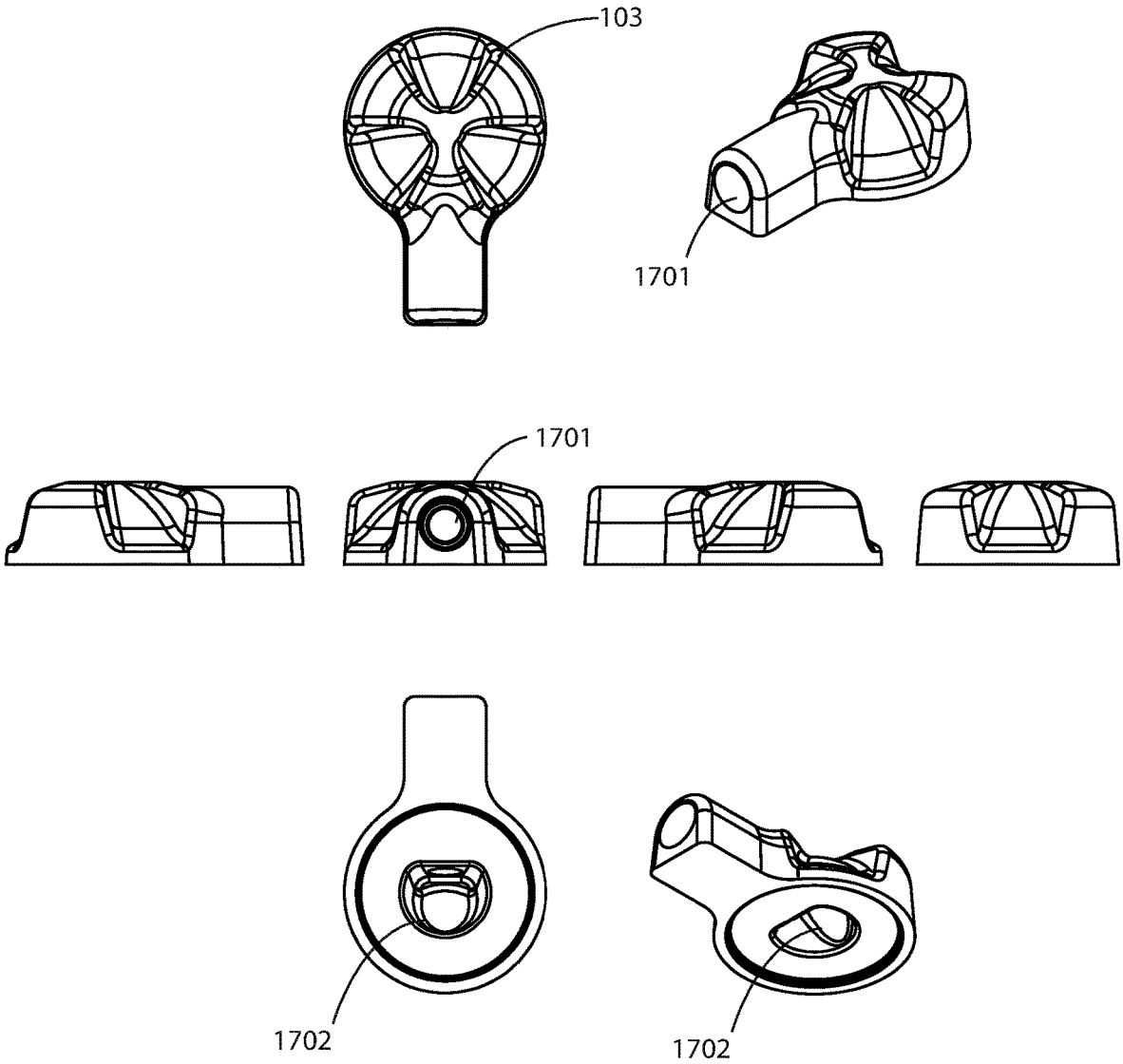
FIG. 17 shows various side and perspective views of a further embodiment of a light output of the intensity adapting apparatus.

FIG. 17 shows a variation of the light output end 103. Light connector 102 mounts to opening 1701 and transmits light to light pipe 1702. Light pipe 1702 transmits light into the light collector (109) of the aiming device (108). In this illustrative embodiment, the light pipe 1702 is affixed to output end 103.

Figure 18:
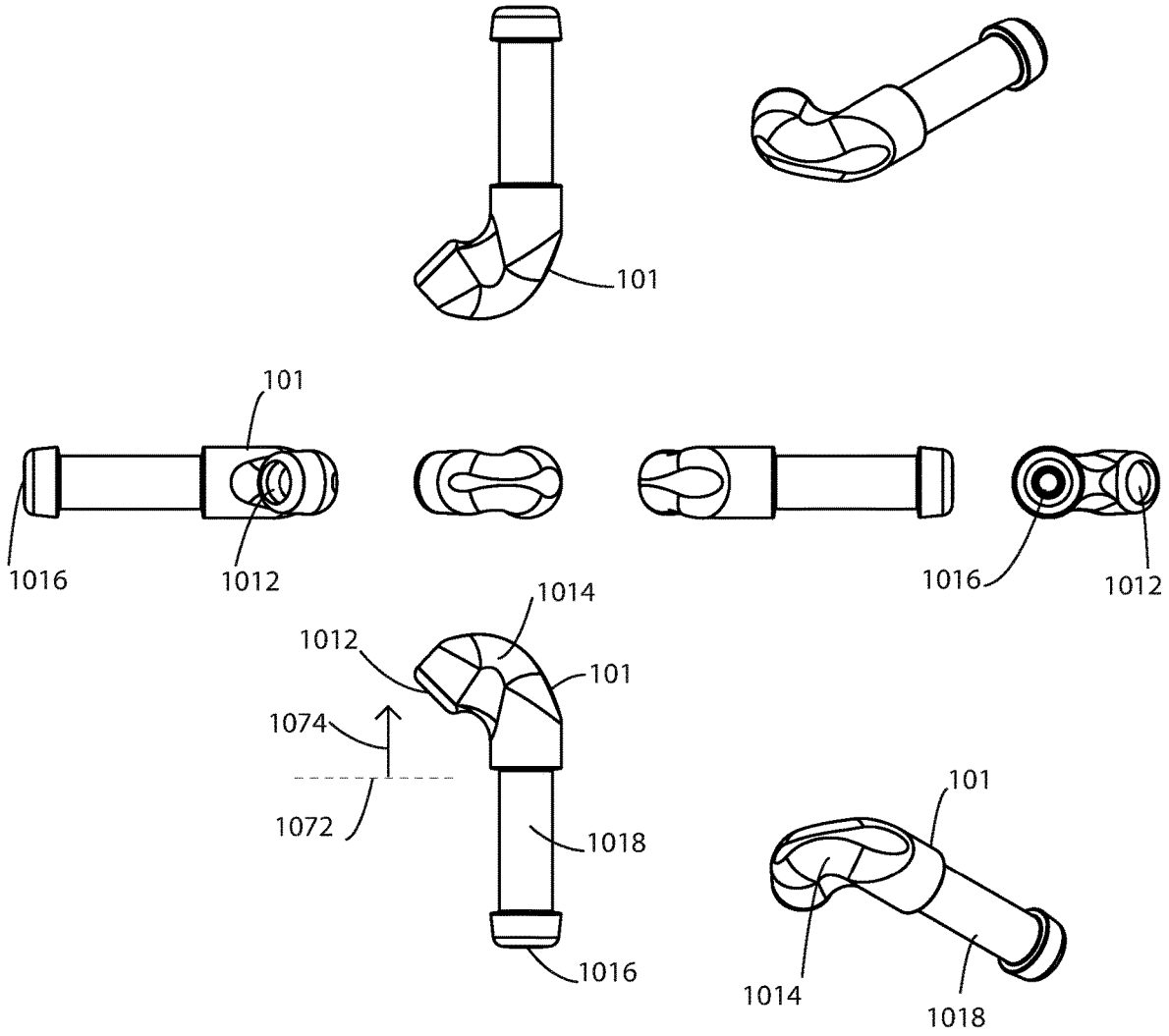
FIG. 18 shows various side and perspective views of embodiments of an input end of the intensity adapting apparatus.

FIG. 18 shows various side and perspective angles of the input end 101 of the intensity adapting apparatus. In various embodiments, a lens 1072 of the light source (107) transmits light generally in a first direction 1074. The input end 101 may include a collector 1012 that is angled such that some portion of the light emitted by the light source is captured by the collector 1012. The collector 1012 may be parallel to the light source lens 1072, or it may be angled relative to the light source lens. Preferably, the angle is less than 90 degrees, and more preferably, less than 45 degrees. The input end 101 further comprises a bend or elbow section 1014 that redirects the light collected to a different direction. The input end 101 may further comprise a light outlet 1016 that directs the collected light into the light connector 102, as discussed more fully below. The input end 101 may further comprise a section 1018 having a reduced diameter, adapted to engage a clip portion (1046) of the input mount (104).

Figure 19:
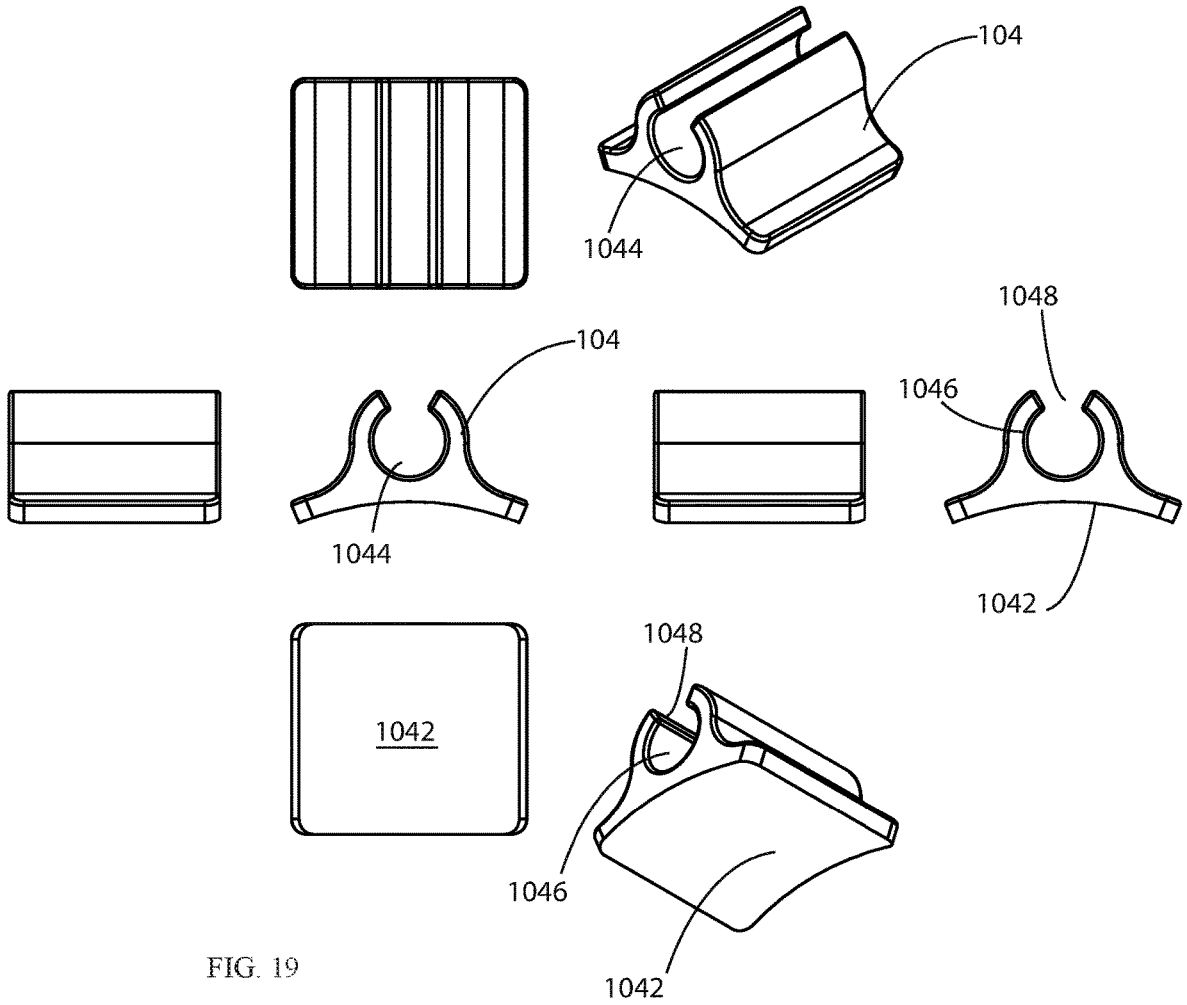
FIG. 19 shows various side and perspective views of embodiments of a light input mount for use with the intensity adapting apparatus.

FIG. 19 shows various side and perspective views of embodiments of a light input mount 104 for use with the intensity adapting apparatus. The mount 104 comprises a mounting surface 1042. The mounting surface may be connected to the light source (107) by adhesive, magnetic, hook-and-loop or other engaging means. The input mount may further comprise a clip section 1044. The clip section is dimensioned to engage a reduced diameter section (1018) of the input end (101) and retain the input end in position with regard to the light source. The clip section 1044 may include a generally cylindrical side wall 1046 with an open section 1048 to allow the input end to be inserted into the clip section 1044.

Figure 20:
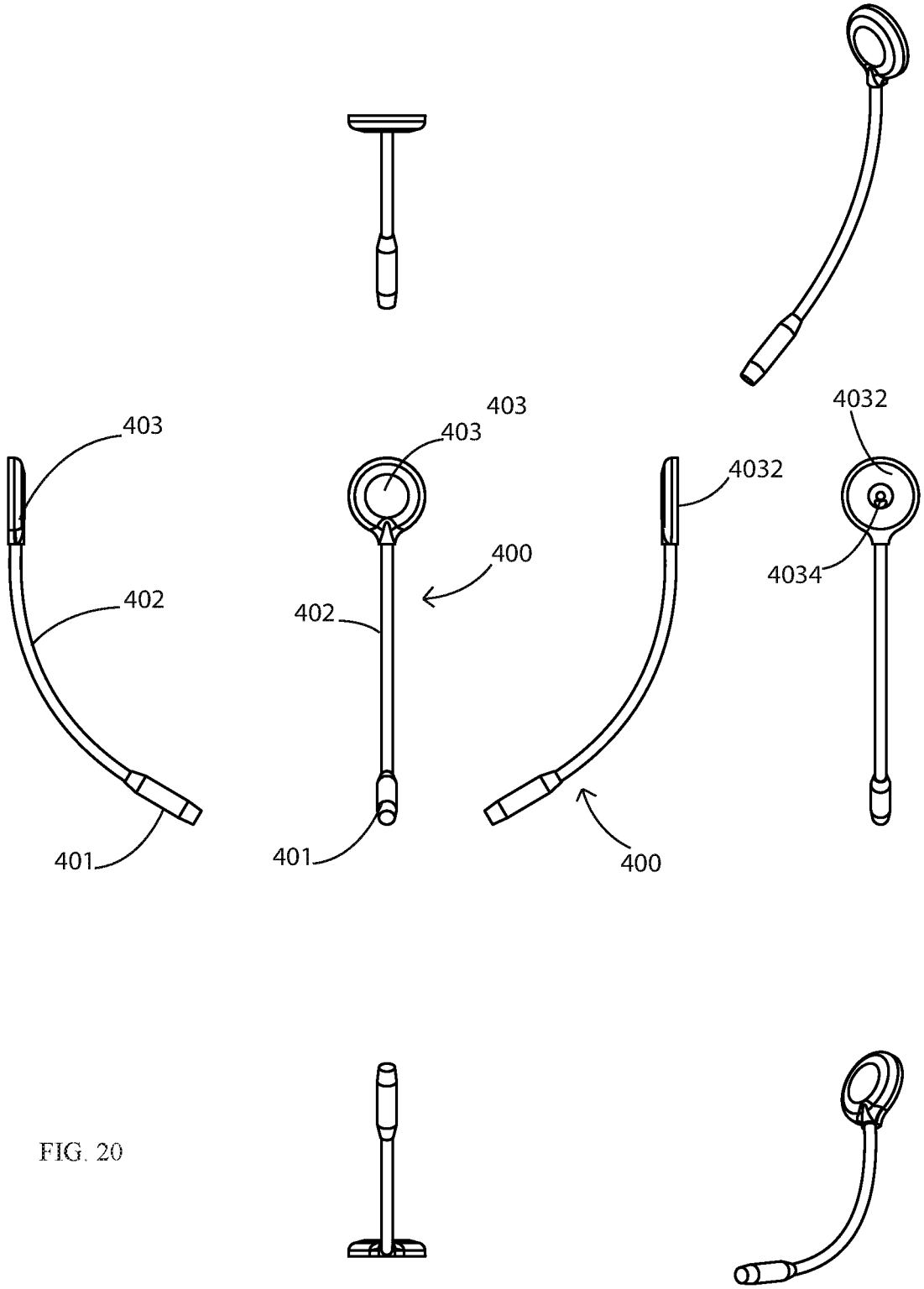
FIG. 20 shows various side and perspective views of embodiments of an intensity adapting apparatus.

FIG. 20 shows various side and perspective views of embodiments of an intensity adapting apparatus. The apparatus shown in FIG. 20 is consistent with the embodiment illustrated in FIG. 4. The intensity adapting apparatus 400 may comprise an input end 401 and a light output end 403. The input end 401 and output end 403 may be connected by a light connector 402. The light connector may be formable. The output end 403 may include an engaging surface 4032 that is adapted to engage a surface of the reticle light collector (109). The engaging surface 4032 may be substantially flat. A light outlet opening 4034 may be positioned within the perimeter of the flat surface 4032. The outlet opening 4034 may be a physical opening or may be an optical opening, comprising an optically transparent portion of the flat surface without a physical opening.

While the present inventions and what is considered presently to be the best modes thereof have been described in a manner that establishes possession thereof by the inventors and that enables those of ordinary skill in the art to make and use the inventions, it will be understood and appreciated that there are many equivalents to the exemplary embodiments disclosed herein and that myriad modifications and variations may be made thereto without departing from the scope and spirit of the inventions, which are to be limited not by the exemplary embodiments but by the appended claims.

The invention claimed is:

1. An intensity adapting optical aiming system comprising:

an optical aiming device comprising an illuminateable reticle, the optical aiming device having a reticle input that is coupled to the reticle; and a light connector comprising a light transmitting medium that extends between the optical aiming device and a light source, the light connector comprising a light input end and a light output end, the light input end configured to extend into the light path of the light source such that the light input end is directly exposed to the light emitted from the light source and the light output end couples to the reticle input, wherein the light connector transmits light from the light source to the reticle of the optical aiming device; and wherein the light source simultaneously illuminates a target and the light input end of the light connector.

2. The aiming system of claim 1 the light transmitting medium comprises a fiber optic cable.

3. The aiming system of claim 1 further comprising a light input end mount that holds the light input end of the light connector and positions the light input in the path of the light source.

4. The aiming system of claim 3, wherein the light input mount attaches to the light source.

5. The aiming system of claim 4, wherein the light input mount comprises a mounting surface attached to a surface of the light source.

6. The aiming system of claim 3, wherein the light input mount comprises a mounting surface attached to a surface of a weapon.

7. The aiming system of claim 3, wherein the mount further comprises a channel for receiving at least the light input end of the light connector and the channel comprises an arc.

8. The aiming system of claim 3, wherein the arc angles the light input end toward the light emitting end of the light source.

9. The aiming system of claim 8, wherein arc of the channel has an angle between 30 degrees and 240 degrees.

10. The aiming system of claim 1, wherein the reticle input comprises an ambient light collector.

11. The aiming system of claim 1, wherein the light transmission medium is a continuous fiber optical cable such that a first end of the fiber optic cable is the light input end and a second end of the fiber optic cable is the light out end.

12. The aiming system of claim 1, wherein the light source is a flashlight.

13. An intensity adapting optical aiming system comprising:

an optical aiming device comprising an illuminateable reticle and a reticle input, wherein the reticle input is coupled to the reticle and collects light from a primary light source; and a light connector comprising a light transmitting medium that extends between the optical aiming device and a secondary light source, the light connector comprising a light input end and a light output end, the light input end configured to extend into the light path of the secondary light source such that the light input end is directly exposed to the light emitted from the secondary light source and the light output end couples to the reticle input, wherein the light connector transmits light from the secondary light source to the reticle of the optical aiming device; and wherein the secondary light source illuminates a target.

14. The aiming system of claim 13, wherein the primary light source is ambient light.

15. The aiming system of claim 13, wherein the reticle has a first brightness when illuminated only by the primary light source and a second brightness when illuminated by the secondary light source.

16. The aiming system of claim 15, wherein the second brightness is greater than the first brightness.

17. The aiming system of claim 13, wherein the second brightness adapts automatically to the illumination of a target.

18. The aiming system of claim 13, wherein the secondary light source simultaneously illuminates the target and the light input end of the light connector.

19. The aiming system of claim 13, wherein the primary light source and the secondary light source simultaneously illuminate the reticle.

20. The aiming system of claim 13, wherein the secondary light source is positioned on a firearm forward of the reticle.

* * * * *